US007408510B2

(12) United States Patent
Yamamoto et al.

(10) Patent No.: US 7,408,510 B2
(45) Date of Patent: Aug. 5, 2008

(54) PATCH ANTENNA

(75) Inventors: Sadahiko Yamamoto, Osaka (JP); Kazuhiro Kitatani, Osaka (JP); Hidehisa Shiomi, Osaka (JP)

(73) Assignee: SANYO Electric Co., Ltd., Osaka (JP)

( * ) Notice: Subject to any disclaimer, the term of this patent is extended or adjusted under 35 U.S.C. 154(b) by 52 days.

(21) Appl. No.: 10/566,817

(22) PCT Filed: Jul. 30, 2004

(86) PCT No.: PCT/JP2004/011330

§ 371 (c)(1),
(2), (4) Date: Jan. 26, 2006

(87) PCT Pub. No.: WO2005/013418

PCT Pub. Date: Feb. 10, 2005

(65) Prior Publication Data

US 2006/0227051 A1 Oct. 12, 2006

(30) Foreign Application Priority Data

Aug. 1, 2003 (JP) ..... 2003-284755

(51) Int. Cl.
*H01Q 1/38* (2006.01)

(52) U.S. Cl. ..... 343/700 MS; 343/700 MS; 343/702; 343/828; 343/829; 343/846

(58) Field of Classification Search ..... 343/700 MS, 343/702
See application file for complete search history.

(56) References Cited

U.S. PATENT DOCUMENTS

| | | | | |
|---|---|---|---|---|
| 2002/0068602 | A1 * | 6/2002 | Kuriyama et al. | 455/550 |
| 2004/0145528 | A1 * | 7/2004 | Mukai et al. | 343/702 |

FOREIGN PATENT DOCUMENTS

| | | | | |
|---|---|---|---|---|
| JP | 01-204342 | | 3/1991 | 13/8 |
| JP | 03-307021 | | 5/1993 | 13/8 |
| JP | 03-234110 | | 3/1994 | 13/8 |
| JP | 2000-366700 | | 6/2002 | 1/38 |
| JP | 2001-014689 | | 8/2002 | 13/8 |
| JP | 2005 269366 | A * | 9/2005 | |

* cited by examiner

*Primary Examiner*—Trinh V Dinh
(74) *Attorney, Agent, or Firm*—Gerald T. Bodner

(57) ABSTRACT

A patch antenna (10) includes a dielectric substrate (12), a patch conductor (14) and a ground conductor (18) formed on both surfaces thereof. A step (16) is formed on the lower surface of the dielectric substrate, which makes a spacing between the patch conductor and the ground conductor non-uniform in a direction of length of the patch conductor. By making nonuniform the spacing between the patch conductor and the ground conductor in the direction of length of the patch conductor, radiation efficiency and antenna gain are changed in that direction, resulting in asymmetrical directivity.

6 Claims, 7 Drawing Sheets

E-PLANE RADIATION PATTERN
OF PATCH ANTENNA OF EMBODIEMNT

E-PLANE RADIATION PATTERN OF
CONVENTIONAL PATCH ANTENNA

PATCH ANTENNA

TECHNICAL FIELD

The present invention relates to a patch antenna. More specifically, the present invention relates to a patch antenna that has a ground conductor and a patch conductor formed on respective main surfaces of a dielectric substrate and possesses asymmetric directivity, which is used for cellular telephones.

PRIOR ART

In a cellular telephone, since it is used close to the head of a person, there is a decrease in antenna gain under the influence of the head. Thus, in order to reduce the influence of coupling with the human body, it is contemplated to make directivity asymmetrical between the direction of the human body (head) and the other directions.

One example of patch antenna with asymmetrical directivity is disclosed in Japanese Patent Laying-open No. 8-186437 [H01Q 21/28, G01S 7/03, H01Q 13/08, 21/06] (patent document 1) and Japanese Patent Laying-open No. 10-270932 [H10Q 13/08, 19/10] (patent document 2).

The prior art of patent document 1 is provided with a high-frequency phased-array antenna on a low-frequency patch antenna. By achieving wide-range directivity with the low-frequency patch antenna and achieving directivity for a predetermined direction with the high-frequency phased-array antenna, it is possible to design or set arbitrary directivity.

The prior art of patent document 2 is provided with a passive element mounted at a position with a specific spacing from a patch antenna element, two of which are the same in shape and size. The passive element plays a role as reflector and reflects an antenna pattern in an arbitrary direction to obtain asymmetrical directivity.

In the prior art of patent document 1, not only its structure becomes complicated but also its size is too large to be used at relatively low frequencies on which cellular telephones operate, for example. Also, in the prior art of patent document 2, it is necessary to leave a distance of about ½ wavelength between the two patches, and if calculated with a frequency for cellular telephone, 2 GHz, for example, the distance is as long as about 7.5 cm. Therefore, as with the prior art of patent document 1, it is difficult to apply this prior art to small devices such as cellular telephones due to the limited built-in place.

SUMMARY OF THE INVENTION

Therefore, it is a primary object of the present invention to provide a novel patch antenna.

It is another object of the present invention to provide a patch antenna that has asymmetrical directivity and also can be reduced in size.

The present invention is a patch antenna including a dielectric substrate, a ground conductor formed on one main surface of the dielectric substrate, and a patch conductor formed on the other main surface of the dielectric substrate, wherein radiation efficiency is changed in a direction of wavelength-dependent length of the patch conductor.

By changing the radiation efficiency in the direction of wavelength-dependent length of the patch conductor, an antenna directional characteristic in that direction is altered, which makes it possible to achieve asymmetrical directivity.

According to the present invention, the asymmetrical directivity can be achieved just by changing the radiation efficiency, which allows downsizing without having to use any phased-array antenna or reflecting passive element of prior arts.

In one embodiment, for changing the radiation efficiency, a spacing between the patch conductor and the ground conductor is made nonuniform in the direction of wavelength-dependent length.

Additionally, in another embodiment, for making nonuniform the spacing between the patch conductor and the ground conductor, thickness of the dielectric substrate is changed in the direction of wavelength-dependent length of the dielectric substrate.

Moreover, in still another embodiment, for changing the radiation efficiency, a dielectric constant is changed in the direction of wavelength-dependent length.

Besides, by loading a dielectric on the patch conductor, it is possible to decrease the length of the patch conductor of the antenna in the direction of wavelength-dependent length and thus obtain the compact patch antenna in its entirety.

In making it built into a cellular telephone, this patch antenna is arranged in such a manner that the length of the above mentioned patch conductor in the direction of wavelength-dependent length is in parallel with the direction of thickness of the housing of the cellular telephone, and that a side with higher radiation efficiency is faced opposite to a side making contact with the head of a person. By doing this, it is possible to effectively lessen a decrease in antenna gain resulting from coupling with the person's head.

The above described objects and other objects, features, aspects and advantages of the present invention will become more apparent from the following detailed description of the present invention when taken in conjunction with the accompanying drawings.

BRIEF DESCRIPTION OF THE DRAWINGS

FIG. 15 is an illustrative view showing one example of portable information terminal with the patch antenna of the present invention built-in.

BEST MODE FOR PRACTICING THE INVENTION

Figure 1:
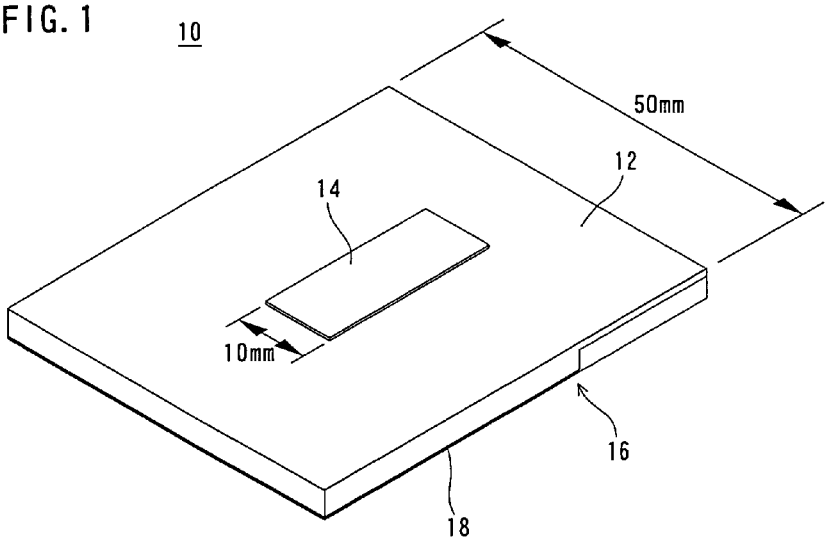
FIG. 1 is a perspective view showing a patch antenna of one embodiment of the present invention.
Figure 2:
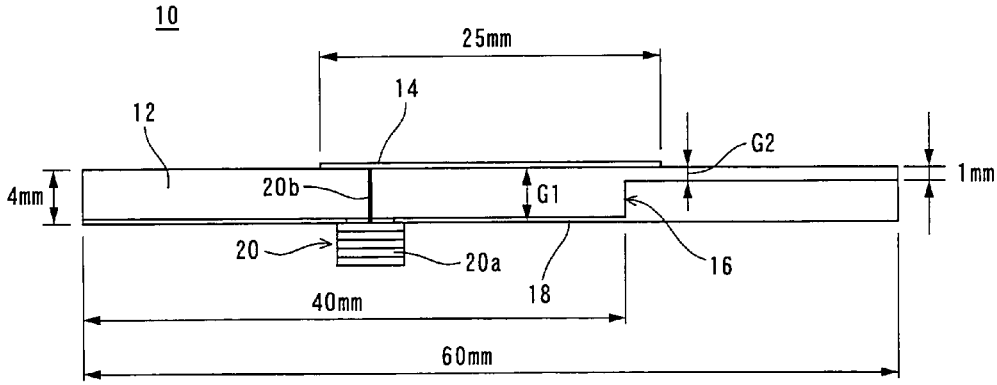
FIG. 2 is a side view of the patch antenna of FIG. 1 embodiment.

A patch antenna 10 of the embodiment shown in FIG. 1 and FIG. 2 includes a substrate 12 formed of a dielectric. In this embodiment, the dielectric substrate 12 is alumina, and its dielectric constant (εr) is 9.7, for example. However, other ceramic dielectrics may be used for the dielectric substrate 12, and also any dielectrics other than ceramic dielectrics may be employed. The dimensions of the patch antenna 10 are about 50 mm wide×60 mm long×4 mm thick in its entirety. However, this size is just one example and may vary depending on the dielectric constant and the frequency.

A patch conductor 14 having a width of 10 mm and made of a metal such as copper is formed on an upper main surface of the dielectric substrate 12 at a center in a width direction of the substrate. Also, a length of the patch conductor 14 is determined by a wavelength (frequency) used with this antenna. Since the patch antenna 10 of this embodiment is to be used for cellular telephones with a frequency band of 2 GHz, the patch conductor 14 is assumed to be 25 mm long. Such length depending on the wavelength may be called wavelength-dependent length.

In addition, a step 16 is formed on a lower main surface of the dielectric substrate 12, as can be seen well from FIG. 2, in particular. In this embodiment, assuming that the length of the dielectric substrate 12 in the above mentioned wavelength-dependent direction is 60 mm, the step 16 is formed at a position of 40 mm from a left end of the dielectric substrate 12. However, the position of the step 16 is just one example and may be changed as appropriate within a range of the length of the patch conductor 14, that is, under the patch conductor 14.

Moreover, formed on the whole lower main surface of the dielectric substrate 12 having the above stated step 16 is a ground conductor 18 made of a metal such as copper as with the patch conductor 14.

Furthermore, a connector 20 is provided on the lower main surface of the dielectric 12. An outer conductor 20*a* of the connector 20 is connected to the ground conductor 18, and an inner conductor 20*b* thereof is passed through the ground conductor 18 and the dielectric substrate 12 to the upper main surface of the dielectric substrate 12, and connected with the patch conductor 14.

By forming the step 16 on the dielectric substrate 12 as stated above, a spacing between the patch conductor 14 and the ground conductor 18 becomes nonuniform between a range of 22.5 mm on the left side of the patch conductor 14 and a range of 2.5 mm on the right side of the same in the direction of length. More specifically, a spacing G1 between the patch conductor 14 and the ground conductor 18 is 4 mm on the left side, whereas a spacing G2 between the patch conductor 14 and the ground conductor 18 is 1 mm on the right side. That is, in this embodiment, the thickness of the dielectric substrate 12 is nonuniform in the direction of the wavelength-dependent length of the patch conductor 14.

Figure 3:
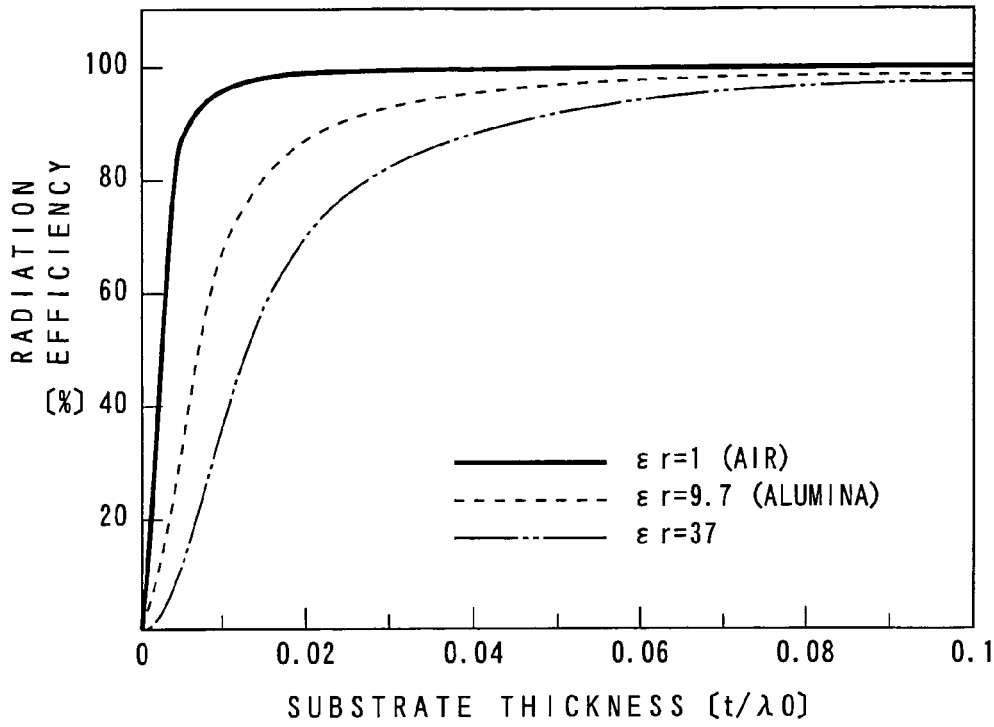
FIG. 3 is a graph showing changes in radiation efficiency measured at an experiment with FIG. 1 embodiment.
Figure 4:
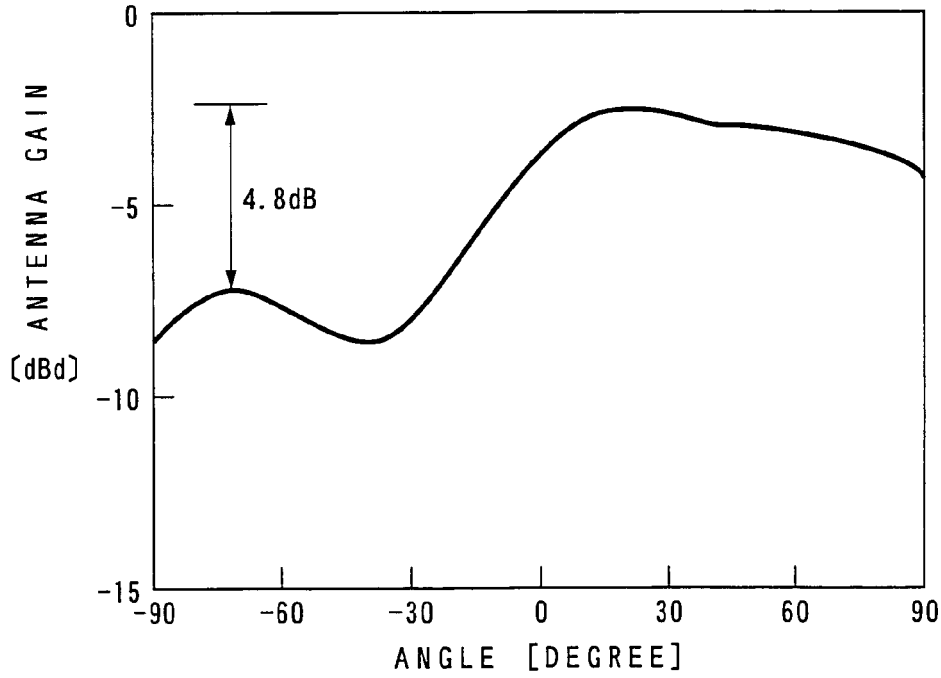
FIG. 4 is an illustrative view showing changes in antenna gain calculated with FIG. 1 embodiment.
Figure 5:
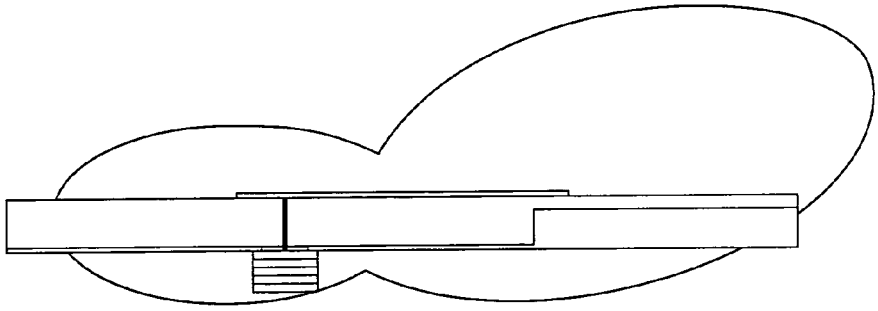
FIG. 5 is an illustrative view showing an E-plane radiation pattern obtained with FIG. 1 embodiment.
Figure 6:
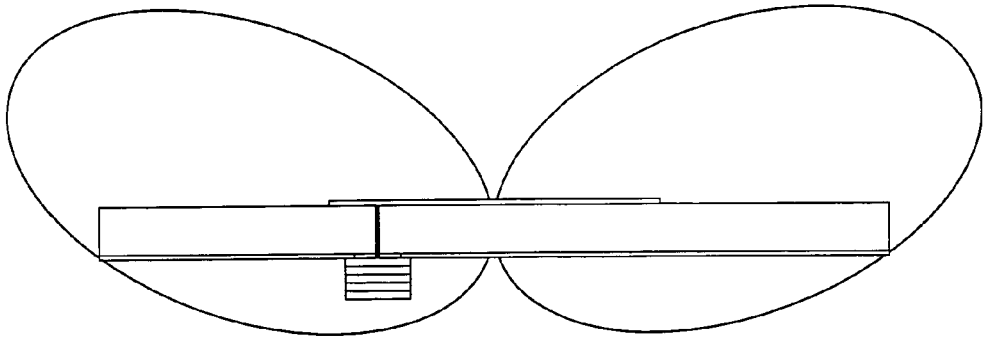
FIG. 6 is an illustrative view showing an E-plane radiation pattern of a conventional patch antenna.

When the thickness of the substrate is discontinuous or nonuniform, it can be seen that the radiation efficiency varies depending on the thickness of the substrate according to an experimental result shown in FIG. 3. In FIG. 3, a solid line shows changes in radiation efficiency (εr) in the air with a dielectric constant of 1, a dotted line shows changes in radiation efficiency in the case of this embodiment using an alumina substrate with a dielectric constant of 9.7, and a dashed line shows changes in radiation efficiency in the case of using a substrate with a dielectric constant of 37. In this manner, by changing the radiation efficiency in the direction of wavelength-dependent length, an antenna gain becomes asymmetrical as shown in FIG. 4, which thus make it possible to achieve asymmetrical directivity as shown in FIG. 5. For reference's sake, FIG. 6 represents a conventional patch antenna's directivity. However, this directivity of FIG. 6 is symmetrical.

Figure 7:
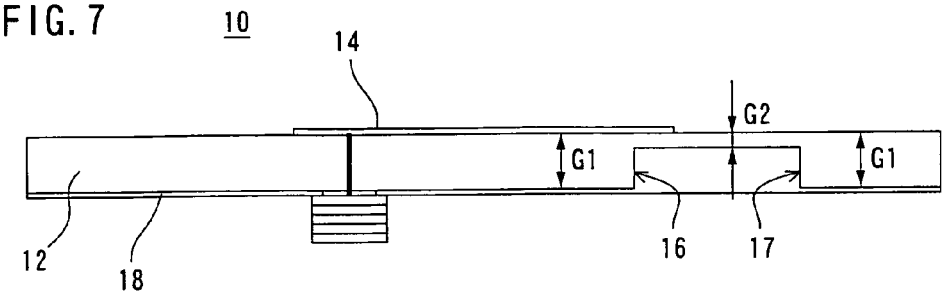
FIG. 7 is an illustrative view showing a modified example of FIG. 1 embodiment.

In the embodiment shown in FIG. 1 and FIG. 2, the dielectric substrate thickness (the spacing between the patch conductor and the ground conductor) is kept at 1 mm on the right side of the step 16 so that the thickness becomes nonuniform in the direction of wavelength-dependent length. Alternatively, as with an embodiment shown in FIG. 7, the substrate thickness may be reduced only at one part in the direction of length. More specifically, in the FIG. 7 embodiment, the substrate thickness G2 between the step 16 and a step 17 is made smaller than the substrate thickness G1 at the remaining area. In this embodiment, G1=4 mm and G2=1 mm. The result of the experiment has revealed that the radiation characteristic in the direction of length of the patch antenna 10 exhibits left-right asymmetry in the FIG. 7 embodiment as well. Therefore, the patch antenna 10 of the FIG. 7 embodiment has also asymmetrical directivity.

Figure 8:
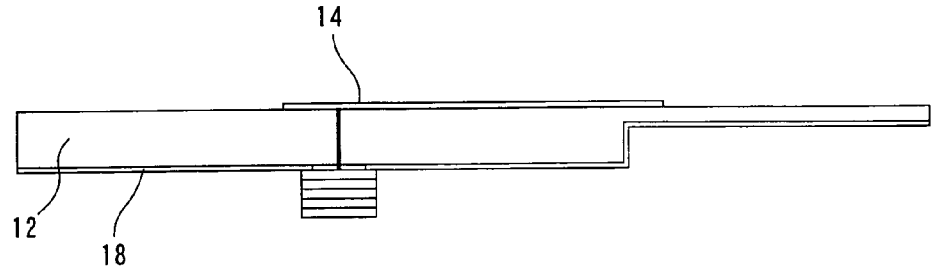
FIG. 8 is an illustrative view showing another modified example of FIG. 1 embodiment.
Figure 9:
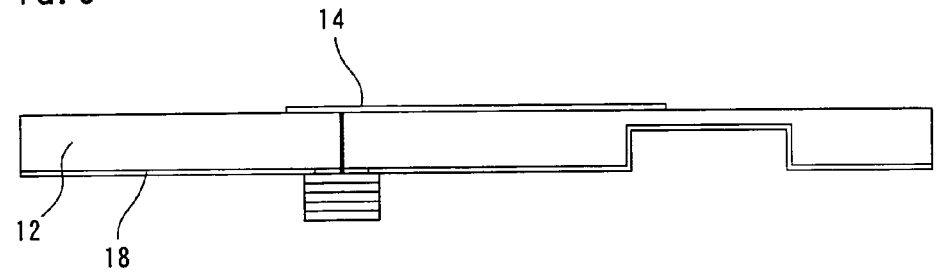
FIG. 9 is an illustrative view showing still another modified example of FIG. 1 embodiment.

Moreover, in both of the above mentioned two embodiments, the thickness of the ground conductor 18 is increased at the thinner part of the patch antenna so that the patch antenna has a uniform thickness of 4 mm, for example, in its entirety. Alternatively, as shown in FIG. 8 and FIG. 9, the thickness of the conductor 18 may be uniform regardless of the thickness of the dielectric substrate 12. This would obviously save material for the conductor, but bring about a drop in mechanical strength.

Furthermore, in the above stated embodiments, the thickness of the dielectric substrate 12, that is the spacing between the patch conductor 14 and the ground conductor 18 is nonuniform or discontinuous in order to make the radiation characteristic nonuniform. Alternatively, as with the FIG. 10 embodiment, the dielectric constant may be nonuniform or discontinuous in the direction of length.

Figure 10:
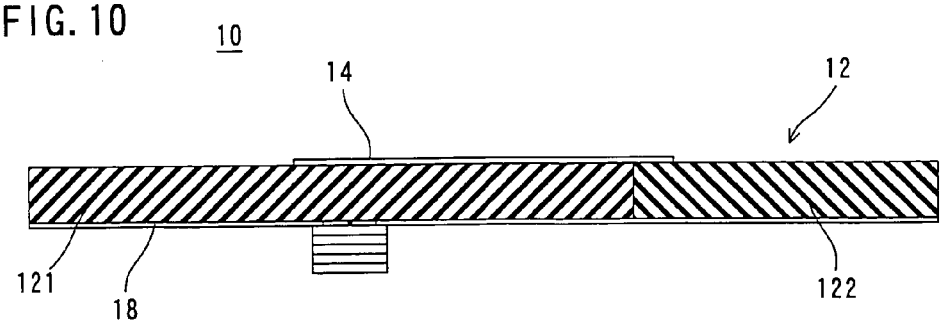
FIG. 10 is an illustrative view showing another embodiment of the present invention.

More specifically, in the patch antenna 10 shown in FIG. 10, the dielectric constant of the dielectric substrate 12 is made discontinuous at a position corresponding to the step in the above mentioned embodiments. For example, a left dielectric substrate 121 is formed of alumina, for example, and its dielectric constant is 9.7, for example, and a right dielectric substrate 122 is formed of high-dielectric ceramic, for example, and its dielectric constant is 37, for example. In this manner, by changing the dielectric constant of the dielectric substrate 12 in the direction of wavelength-dependent length of the patch conductor 14, the radiation characteristic in that direction can be also made nonuniform, and thus it is possible to realize asymmetrical directivity.

Besides, in the above mentioned embodiments, asymmetrical directivity is achieved within an E-plane of the patch antenna. However, the present invention can be also used for realization of asymmetrical directivity within an H-plane.

Figure 11:
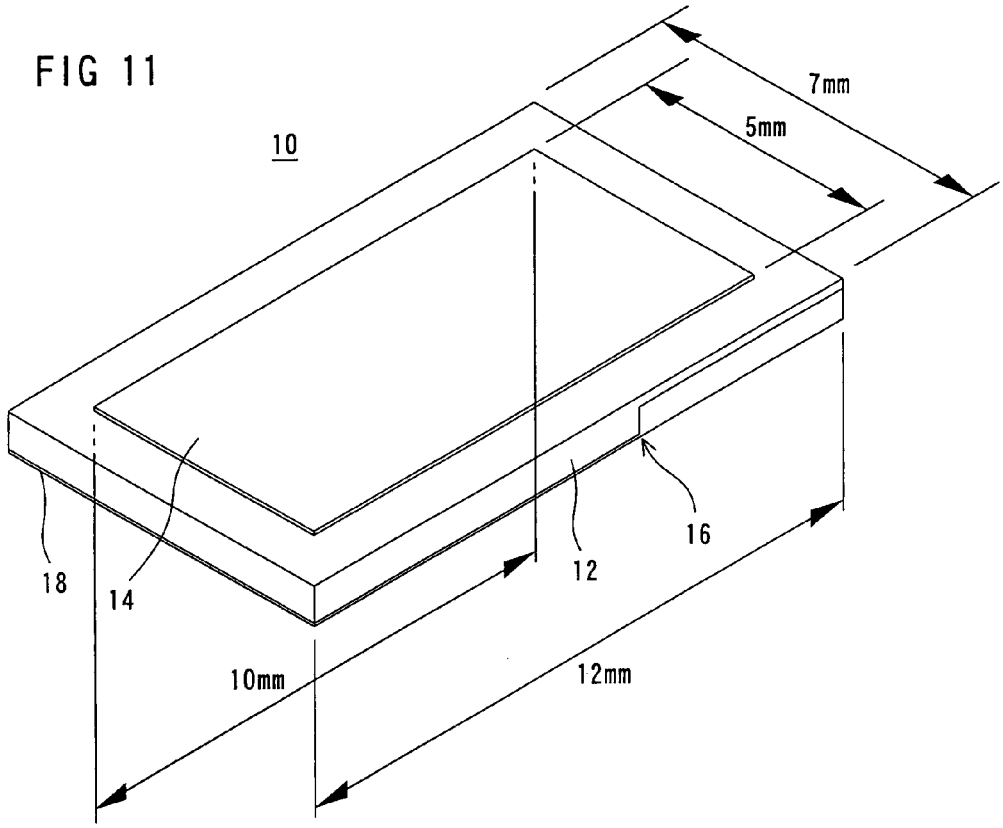
FIG. 11 is a perspective view showing a patch antenna of still another embodiment of the present invention.
Figure 12:
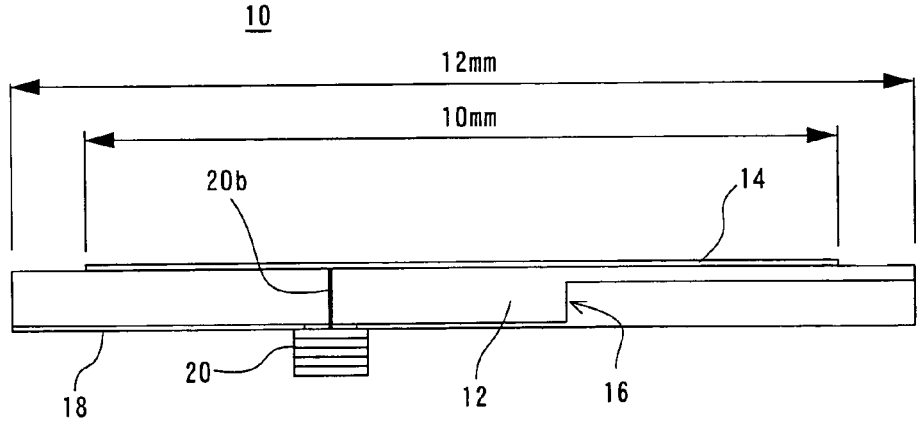
FIG. 12 is a side view of the patch antenna of FIG. 11 embodiment.

In the above described embodiments, by forming the dielectric substrate 12 from a material with a high relative dielectric constant, the above stated antenna size can be further reduced. More specifically, a material with a relative dielectric constant of 100 or more may be used for that. FIG. 11 and FIG. 12 show still another embodiment of the present invention in which the size is reduced by means of such a high relative dielectric constant.

In the embodiment shown in FIG. 11 and FIG. 12, the dielectric substrate 12 made of a dielectric material with a relative dielectric constant of 100 or more is employed, and the size of the dielectric substrate 12 is 7×12 mm, for example.

In addition, as a matter of course, the radiation efficiency of the patch antenna 10 is changed in the direction of antenna length (the direction of wavelength-dependent length of the patch conductor 14) in the embodiment shown in FIG. 111 and FIG. 12 as well. More specifically, in this embodiment, the step 16 is formed on the dielectric substrate 12.

Figure 13:
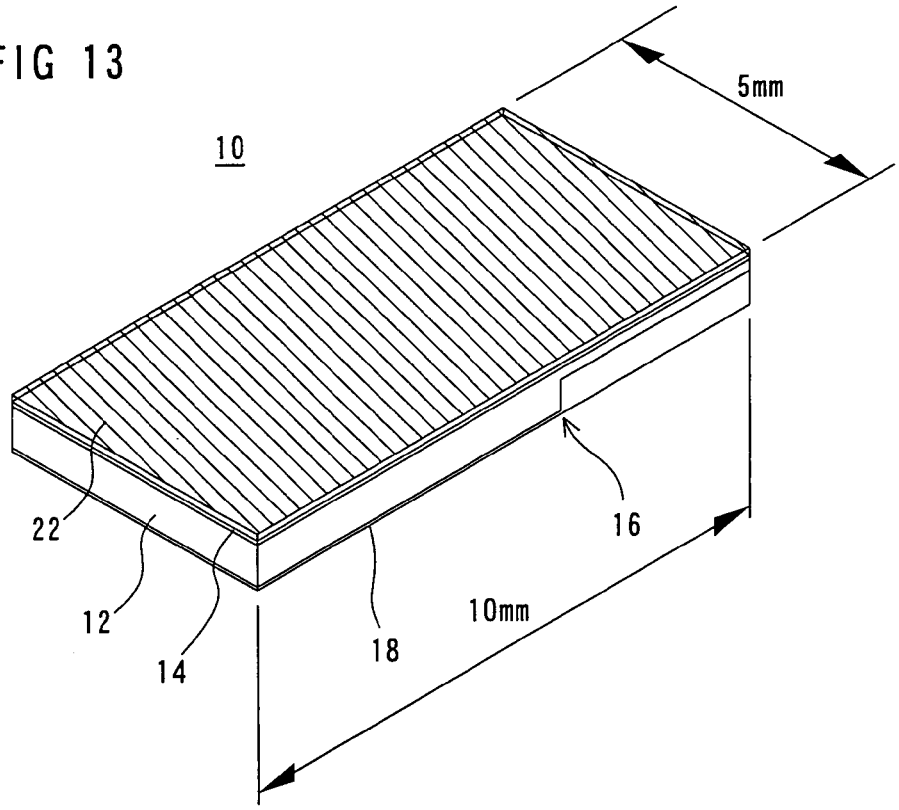
FIG. 13 is a perspective view showing a patch antenna of yet another embodiment of the present invention.
Figure 14:
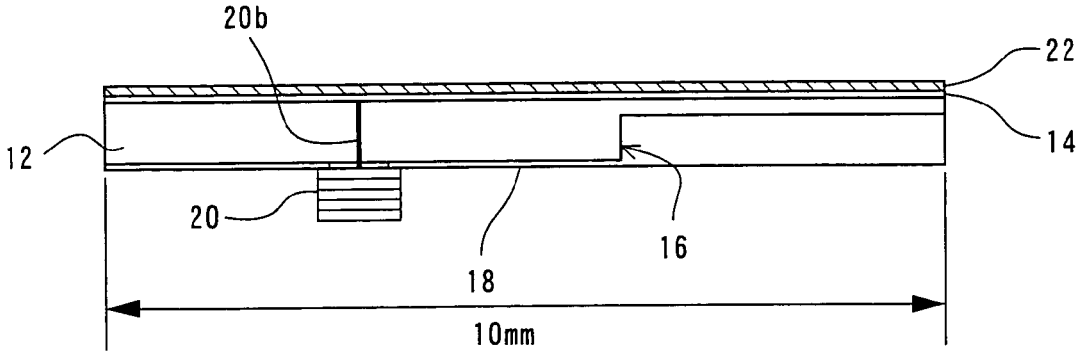
FIG. 14 is a side view of the patch antenna of FIG. 13 embodiment.

For further size reduction, the patch antenna 10 of an embodiment shown in FIG. 13 and FIG. 14 is proposed.

In the embodiment shown in FIG. 13 and FIG. 14, the dielectric substrate 12 is formed by using a material with a relative dielectric constant of 100 or more and its size is 10×5 mm, for example. Also, the patch conductor 14 of the same size is formed on the dielectric substrate 12. Loaded on the patch conductor 14 is a dielectric sheet or plate 22 made of the same material as or similar material (with a high relative dielectric constant) to that of the dielectric substrate 12. The size of the loaded dielectric 22 is the same as that of the dielectric substrate 22, 10×5 mm, for example. The remaining area is the same as that of the patch antenna 10 of the embodiment shown in FIG. 11 and FIG. 12.

In addition, as a matter of course, the radiation efficiency of the patch antenna 10 is also changed in the direction of antenna length (the direction of wavelength-dependent length of the patch conductor 14) in the embodiment shown in FIG. 13 and FIG. 14. More specifically, in this embodiment as well, the step 16 is formed on the dielectric substrate 12.

The patch antenna 10 can be built into a cellular telephone if its length is about 10 mm as with the embodiment shown in FIG. 11 and FIG. 12 and the embodiment shown in FIG. 13 and FIG. 14.

Figure 15:
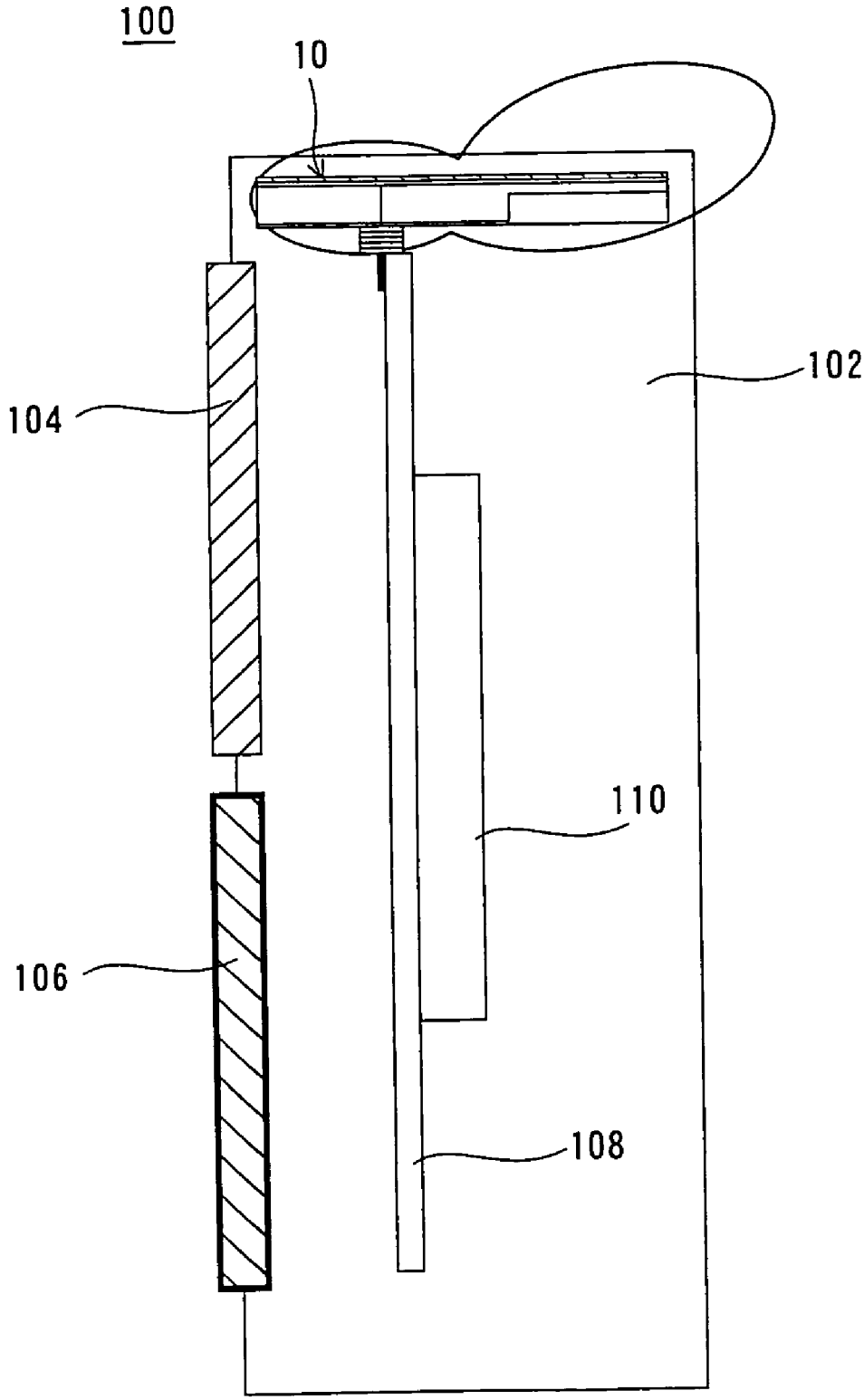

FIG. 15 shows a state of the patch antenna 10 of the above mentioned embodiments that is built into a cellular telephone. The cellular telephone 100 includes a housing 102. A display 104 made of an LCD panel, for example, is formed on one side of the housing 102, that is, on the side coming close to or making contact with the head of a person (not illustrated). A keyboard 106 is arranged on the same side below the display 104. Thus, the user can operate the keyboard 106 to send or receive e-mail while watching the display 104.

Meanwhile, the housing 102 has a built-in substrate 108 on which a required electronic circuit 110 (including a computer chip, a memory device, etc., for example) is mounted. The patch antenna 10 is preferably attached to the substrate 108 and, although not shown, connected to the electronic circuit 110 via a lead. However, since it is well known how to connect an antenna with a cellular telephone, a more detailed description on that is omitted here. The patch antenna 10 is arranged in such a manner that the direction of its length (the direction of wavelength-dependent length of the patch conductor 14) matches the direction of thickness of the housing 102. Thus, the housing 102 of the cellular telephone 100 of this embodiment is at least 10 mm or more in thickness. In addition, if the patch antenna 10 is further reduced in size, it is possible to decrease the thickness of the housing 102 of the cellular telephone 100 accordingly.

In making a call or receiving a call on the cellular telephone 100 of this embodiment, as being commonly well known, a person has a conversation with a speaker (not shown) provided in the vicinity of the display 104, on his/her ear. Thus, the patch antenna 10 is coupled with the human body on the side thereof having the display 104, that is, the side thereof making contact with the head of a person.

Accordingly, in an embodiment of FIG. 15, the patch antenna 10 is arranged in such a manner that the side of the patch antenna 10 with higher radiation efficiency, that is, the side with a larger radiation pattern is faced opposite to the side making contact with the person's head. By doing this, the antenna characteristic of the cellular telephone 10 can be less affected by the coupling with the human body.

Besides, in the embodiment of FIG. 15, the patch antenna 10 is arranged at an upper part inside the housing 102 of the cellular telephone 100. Nevertheless, the arrangement position of the patch antenna 10 may be an arbitrary one. For example, a lower end inside the housing 102 is easily conceivable for that.

Moreover, in the embodiment of FIG. 15, the housing 102 of the cellular telephone 100 is of straight type. Alternatively, it may be a foldable or collapsible housing, rotatable housing, or slidable housing. In this case as well, the antenna may be stored at an arbitrary possible place.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A patch antenna, which comprises:

a dielectric substrate having a first surface and a second surface situated opposite the first surface, and further having a first thickness and a second thickness situated adjacent the first thickness, and an abrupt step in thickness situated between the first thickness and the second thickness, the first thickness being different from the second thickness;

a patch conductor situated in proximity to the first surface of the dielectric substrate, the patch conductor having a first end and a second end situated opposite the first end, and further having a center situated equidistantly between the first end and the second end; and a ground conductor situated in proximity to the second surface of the dielectric substrate, whereby the dielectric substrate is interposed between the patch conductor and the ground conductor;

wherein the abrupt step in thickness is situated in alignment with the patch conductor between the first end and the second end of the patch conductor and offset from and in non-alignment with the center of the patch conductor;

and wherein the patch antenna exhibits a radiation pattern which is asymmetric along the length of the antenna due to the abrupt step in thickness of the dielectric substrate.

2. A patch antenna according to claim 1, wherein a spacing between said patch conductor and said ground conductor is made non-uniform in a direction of wavelength-dependent length of said patch conductor.

3. A patch antenna according to claim 1, wherein a dielectric constant of the dielectric substrate is changed in a direction of wavelength-dependent length of said patch conductor.

4. A patch antenna according to claim 1, wherein a dielectric is loaded on said patch conductor.

5. A cellular telephone with a patch antenna built-in according to claim 1, wherein said cellular telephone includes a housing having a thickness, and said patch antenna is arranged in such a manner that a direction of wavelength-dependent length of said patch conductor matches the direction of thickness of said housing, and that a side thereof with higher radiation efficiency is faced opposite to a side of said housing making contact with a head of a person.

6. A patch antenna according to claim 1, wherein said dielectric substrate is a single dielectric substrate having a uniform dielectric constant.

* * * * *